US007392749B2

(12) United States Patent
Bendig et al.

(10) Patent No.: US 7,392,749 B2
(45) Date of Patent: Jul. 1, 2008

(54) LOCOMOTIVE PROPULSION SYSTEM MODULE FOR REFURBISHMENT OF USED LOCOMOTIVES

(75) Inventors: John B. Bendig, Waterford, PA (US); Alexander G. Grigorian, Erie, PA (US); Joseph J. McQuiston, Erie, PA (US)

(73) Assignee: General Electric Company, Schenectady, NY (US)

( * ) Notice: Subject to any disclaimer, the term of this patent is extended or adjusted under 35 U.S.C. 154(b) by 366 days.

(21) Appl. No.: 11/117,167

(22) Filed: Apr. 28, 2005

(65) Prior Publication Data

US 2005/0279243 A1 Dec. 22, 2005

Related U.S. Application Data

(60) Provisional application No. 60/580,404, filed on Jun. 16, 2004.

(51) Int. Cl.
*B61C 1/00* (2006.01)

(52) U.S. Cl. ..... 105/26.05; 105/172

(58) Field of Classification Search ..... 105/59, 105/26.05, 35, 49
See application file for complete search history.

(56) References Cited

U.S. PATENT DOCUMENTS 3,116,700 A * 1/1964 Aydelott ..... 105/59
2004/0149159 A1 * 8/2004 Foesel et al. ..... 105/26.05

* cited by examiner

*Primary Examiner*—Mark T Le
(74) *Attorney, Agent, or Firm*—John A. Kramer; Timothy H. Van Dyke; Beusse Wolter Sanks Mora & Maire

(57) ABSTRACT

A propulsion skid module useful for refurbishing locomotives is taught. In one embodiment, the propulsion skid module includes a skid base serving as a support for an engine; the skid base including at least two support members extending substantially the length of the module and at least one panel spanning the two support members; with the module further comprising an engine; a blower for delivery of air under pressure, a control device compartment, an auxiliary cab including power connectors, and an air compressor secured onto the skid base; and an air plenum defined in the base. Methods for refurbishing a locomotive are also taught.

8 Claims, 12 Drawing Sheets

LOCOMOTIVE PROPULSION SYSTEM MODULE FOR REFURBISHMENT OF USED LOCOMOTIVES

CROSS-REFERENCE TO A RELATED APPLICATION

This application claims the benefit of U.S. Provisional Patent Application Ser. No. 60/580,404 filed Jun. 16, 2004, incorporated herein by reference.

BACKGROUND

Many older locomotives comprise systems, such as the operator cab, the drive system (i.e., the traction motors, trucks and undercarriage of the locomotive), and brake system that are capable of continuing to provide additional years of reliable operation with minor repairs, and comprise other systems, such as the propulsion system, that are outdated, unreliable or inefficient, and thus are in need of extensive repair or replacement. Overhauling older locomotives is a complex and time-consuming process requiring the rebuilding of the engine, replacement or rewinding of the alternator, and updating of electrical components, many of which are obsolete and thus no longer commercially available. In most cases, the cost and time required to refurbish an older locomotive on a component-by-component basis is not cost-effective, thereby leaving (until the advent of applicants' invention) the purchase of a newer, complete locomotive as the only realistic and viable option. As a result, systems and components still possessing operational life are put to waste. The inventors have realized that there is a need for a reliable and cost effective system for replacing outdated, worn locomotive systems while providing for the conservation of older, yet highly functional locomotive systems.

DETAILED DESCRIPTION

The subject invention pertains to a prefabricated propulsion system module comprising all of the propulsion components necessary for operation. The module is capable of being installed onto a locomotive platform as a single modular working unit. Furthermore, the prefabricated propulsion system module or skid comprises all of the necessary connections for facile interconnection to the conserved systems remaining on the locomotive. The module is typically fashioned for placement onto the platform located behind the operator's cabin, which retains the drive system components, including the traction motors. The subject invention allows for dramatic reduction in costs and time expenditures. The time involved in learning the skills and techniques for installing a propulsion system module embodiment of the invention, and the skills required for such installation, is dramatically low. Also, maintenance costs are substantially decreased due to ease of repair and longer time intervals between necessary maintenance.

In a typical embodiment, the module comprises external connections: including power connections to the traction motors; to the operator cab console wiring; control wiring connections to train line control wiring; and wiring to the battery cables; and the locomotive lighting.

In another embodiment, the subject invention pertains to a method of refurbishing a locomotive. This method comprises removing the old propulsion system and all of the cabs (carbody), except the operator cab, from the locomotive leaving a locomotive platform that comprises existing traction motors, positioning a propulsion system module onto the platform over the existing traction motor air ducts; and connecting the components of the module to the proper systems and parts on said locomotive. In an alternative embodiment, the operator cab is also removed from the platform; in such alternative embodiment, an operator cab is built onto the propulsion module.

Figure 1:
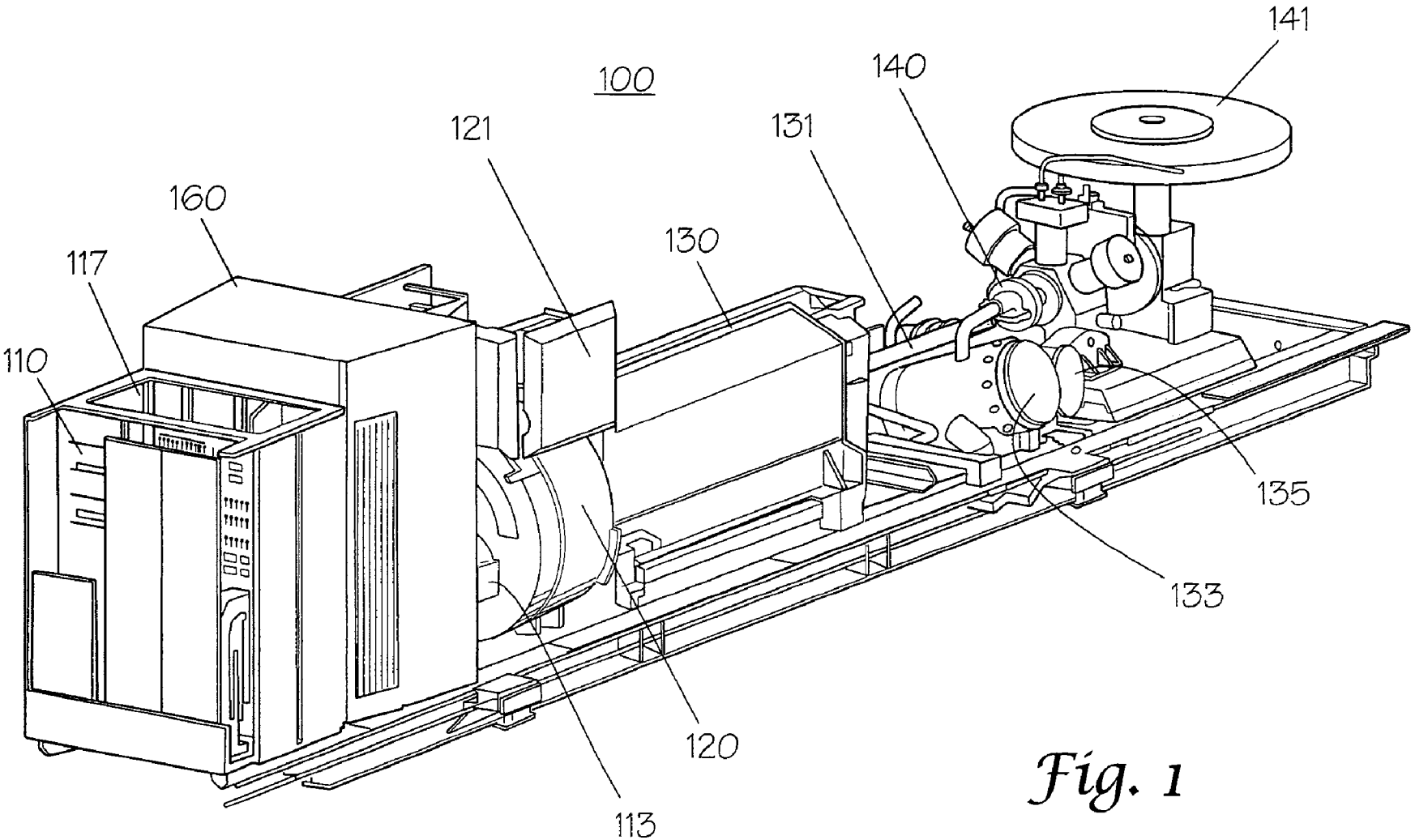
FIG. 1 shows a perspective view of a propulsion skid module according to one embodiment of the subject invention.

FIG. 1 shows a perspective view of one embodiment of a propulsion system module 100. The module comprises a control device compartment 110. The control device compartment 110 houses a controller (not shown) which is connected to train line control wiring (not shown). Posterior to the control device compartment is the auxiliary cab 117. The auxiliary cab 117 houses the power connections which interconnect to the power wires from the traction motors. Posterior to the auxiliary cab is the blower cab 160. The blower cab houses a blower which generates air flow to an air plenum (as described below) which delivers air to other areas of the module 100 and to ducts provided in the locomotive platform. The module 100 comprises an auxiliary generator/exciter 113, alternator 120 which is shown posterior to the blower cab 160. Above the alternator 120 is the rectifier 121. Shown posterior to the alternator 120 is the locomotive engine 130. Shown posterior to the engine 130 is an air compressor 140. A drive shaft 131 spans between the engine 130 and air compressor 140. Proximate to the air compressor 140 is an oil filter 133 and oil cooler 135. Posterior to the air compressor 140 is the radiator fan 141. Those skilled in the art will appreciate that the propulsion components may have alternate arrangements depending on the dimensions and configuration of the locomotive platform.

Figure 2:
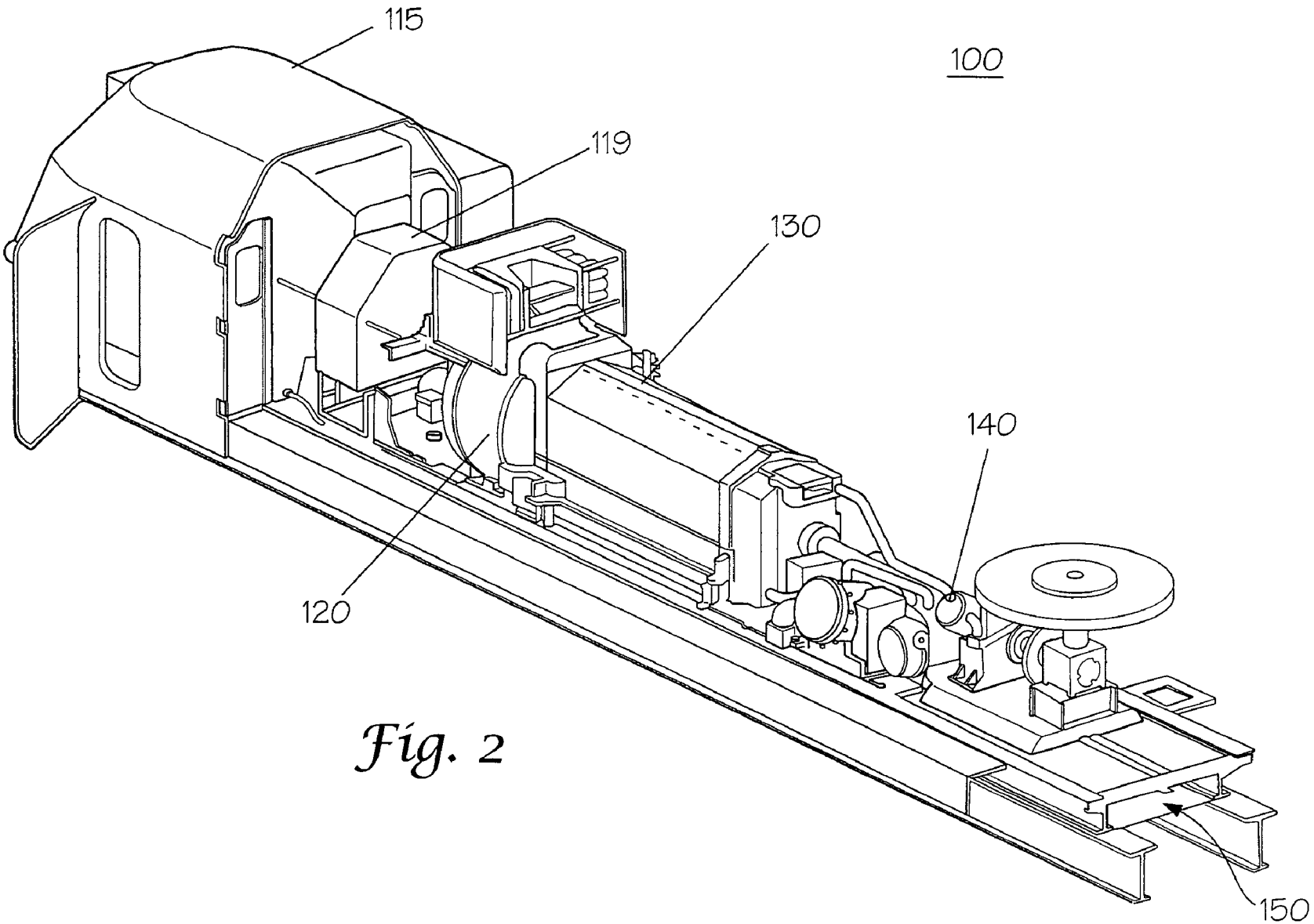
FIG. 2 shows a perspective view of a propulsion skid module embodiment from a different angle than that shown in FIG. 1 and including additional components.

FIG. 2 shows a perspective view of a different angle of the embodiment shown in FIG. 1 showing most of the same components: blower cab 160 with blower 119, alternator 120, engine 130 and air compressor 140. In addition, FIG. 2 shows where the plenum 150 in this embodiment is located under the propulsion components, between the equipment blower and oil cooler. The plenum 150 acts as a conduit to pass forced cooling air toward other cabs (not shown) and to the traction motors (not shown). It may also deliver air to the control device compartment, rectifiers, alternator 120 and auxiliary generator/exciter. FIG. 2 also shows an enclosure 115 forming the exterior of an operator cab.

Figure 3:
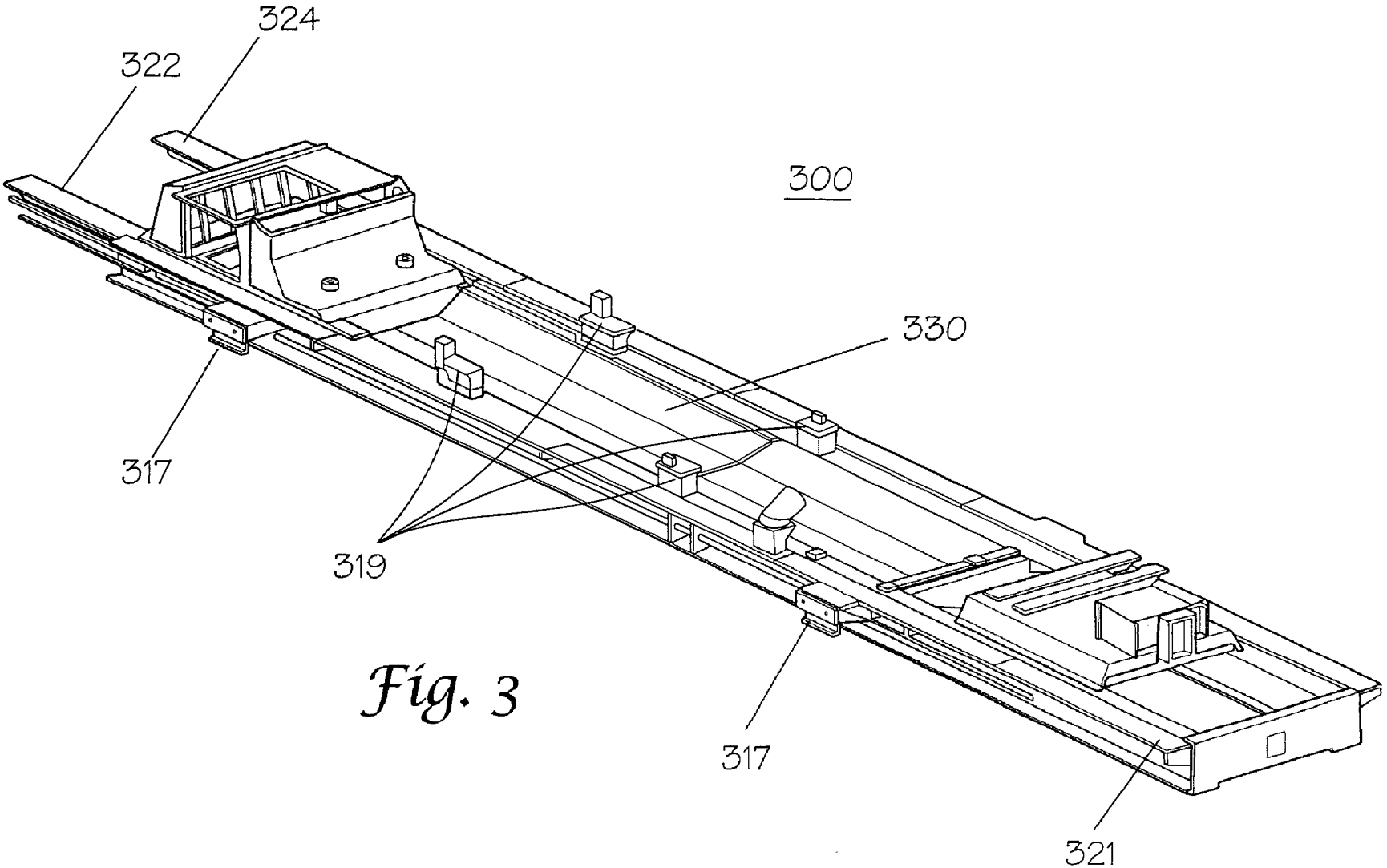
FIG. 3 shows a perspective view of a skid base according to an embodiment of the subject invention.

FIG. 3 shows a perspective view of the skid base 300 onto which the propulsion components of the propulsion system module are mounted. The skid base 300 comprises a first support member 322 and a second support member 324. The support members may comprise I-beam sills. Spanning across the first and second support members 322, 324 is at least one panel 330 (typically three panels). The base 300 includes lifting beams 317 (two on each side) and mounting pads 319 for mounting propulsion components, including engine. On the periphery of the support members 322 and 324 are cab support walkway attachment angles 321. As described in more detail below, panels spanning across from the upper portions of each of the support members 322, 324 forms the top surface of the plenum. Propulsion components rest on the mounting pads 319. The walkway sheets 321 and the cabs are supported on the cab support members 322 and 324.

Figure 4:
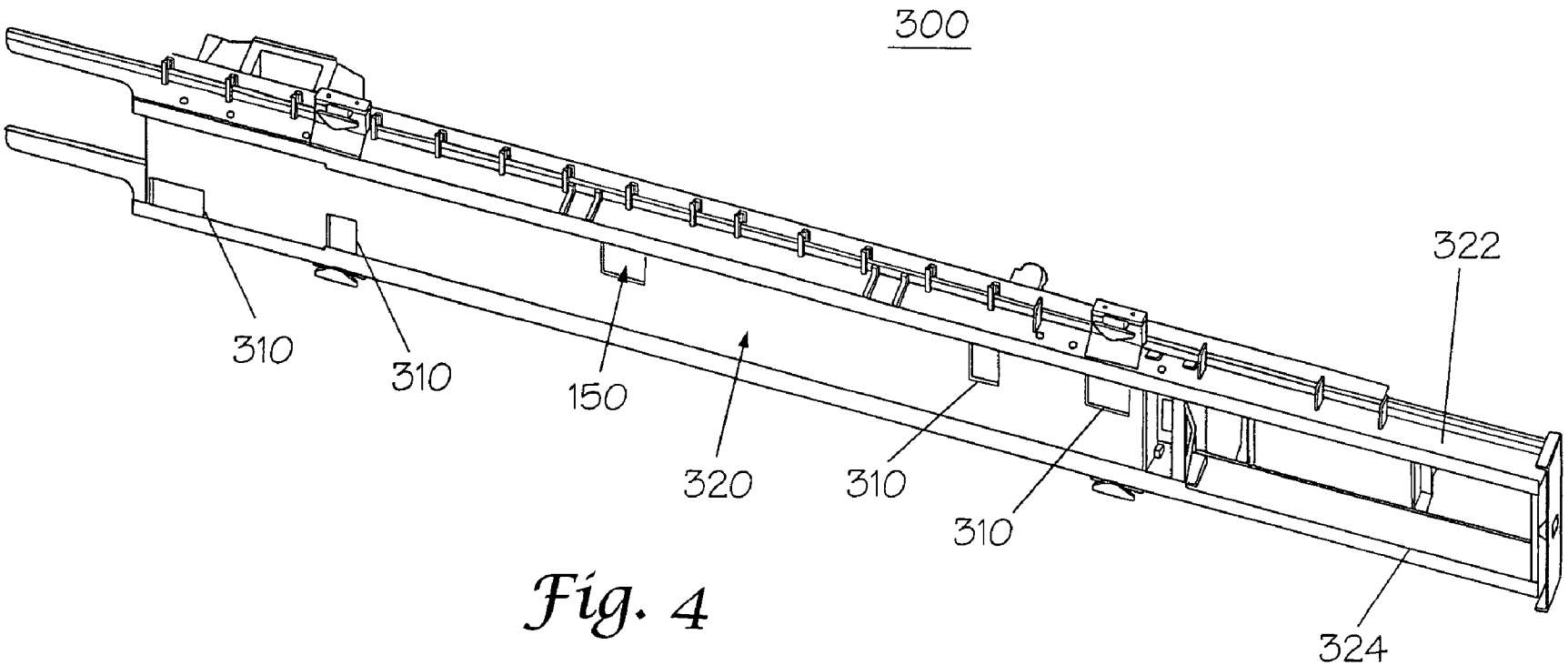
FIG. 4 shows a perspective view of an underside of a skid base according to an embodiment of the subject invention.

FIG. 4 shows a side perspective view of the skid base 300 angled to reveal the bottom portion of the skid base 300. The skid base has a plate 320 spanning across from the lower portions of each of the support members 322, 324. Defined on the plate 320 is a number of portals 310. The portals 310 are designed and positioned so as to match up with air passage conduits on the locomotive platform. This allows passage of air from the blower through the air plenum to the portals 310 to conduits which direct the air to the traction motors for cooling.

Figure 5A:
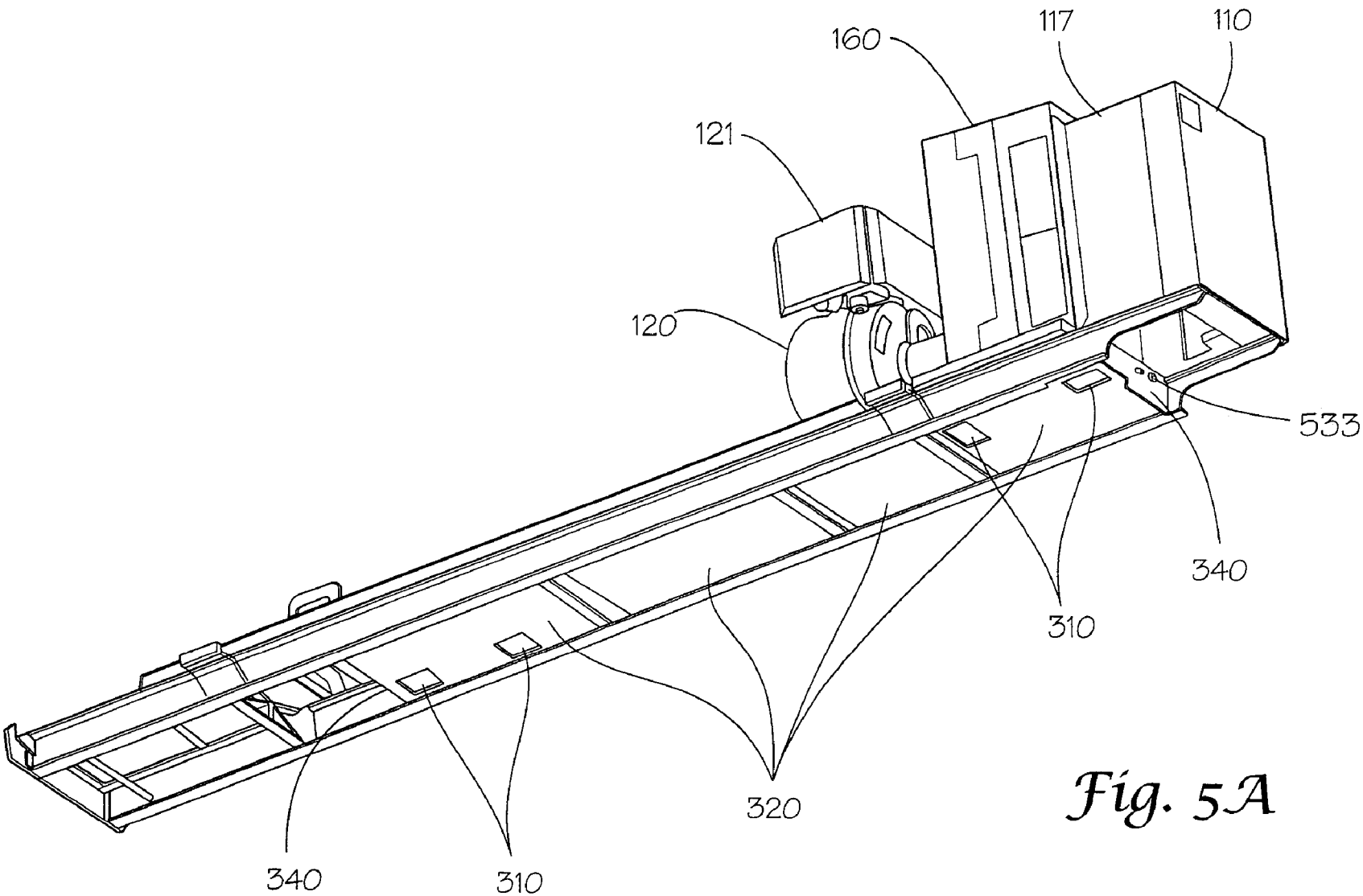
FIG. 5A shows a perspective view of an underside of skid base according to an embodiment of the subject invention.
Figure 5B:
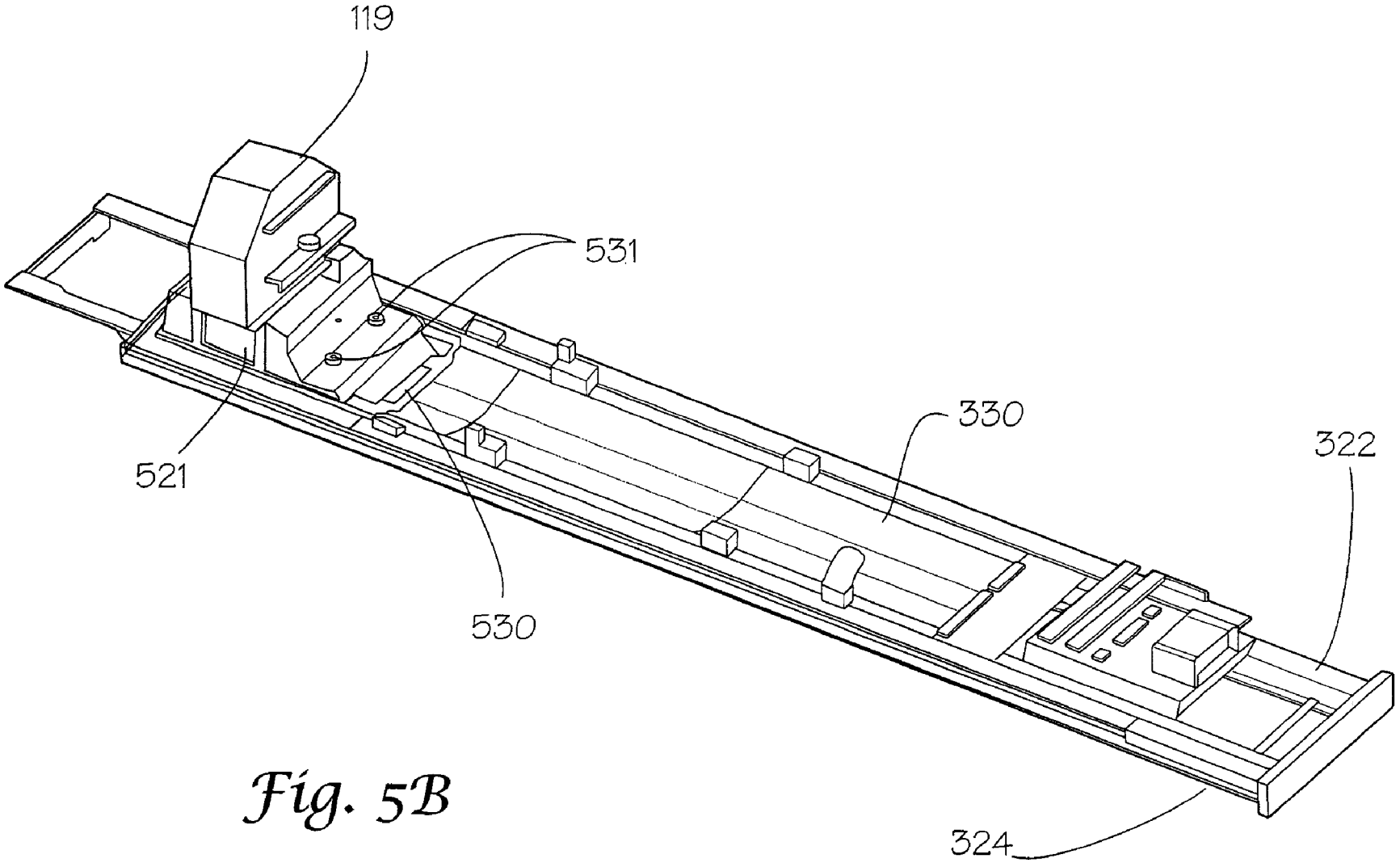
FIG. 5B shows a perspective view of a topside of a skid base according to an embodiment of the subject invention.

FIG. 5A shows a perspective view of a skid base embodiment that is tilted to reveal the lower portion. FIG. 5B shows a top perspective view of a skid base embodiment. Referring to FIGS. 4 and 5A&B, the plenum 150 is formed by the bottom plates 320 to form the bottom wall and panel(s) 330 to form the top wall. Furthermore the plenum 150 is closed on its ends by end plates 340. Air under pressure is directed into the plenum 150 from the blower in the blower cab 160 through an outlet (not shown), positioned under the blower cab 160. 521 represents the blower filter base. The positive pressure of the air in the plenum 150 pushes the air through various exits formed by spaces in the panels so as to deliver air to predetermined locations in the propulsion system module. For example, exit 530 provides air to the alternator 120 and ports 531 deliver air to the exciter/auxiliary generator and rectifier 121. Air is also provided to cool the control device compartment 110 that is shuttled out of the plenum 150 through port 533. Furthermore, the air travels out the portals 310 to deliver air to the traction motors as described above.

Figure 6:
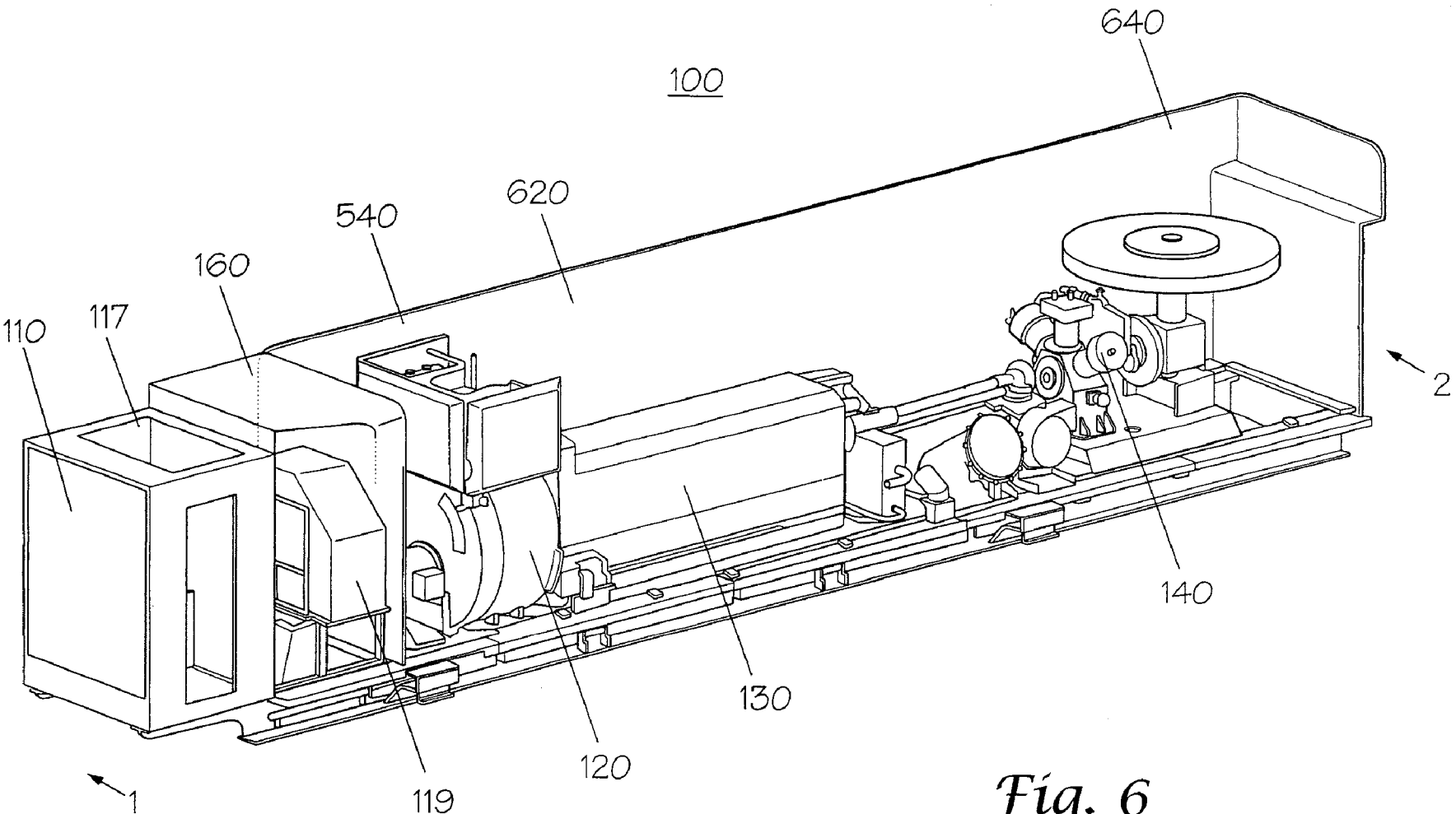
FIG. 6 shows an open side perspective view of a propulsion skid module according to an embodiment of the subject invention.
Figure 7:
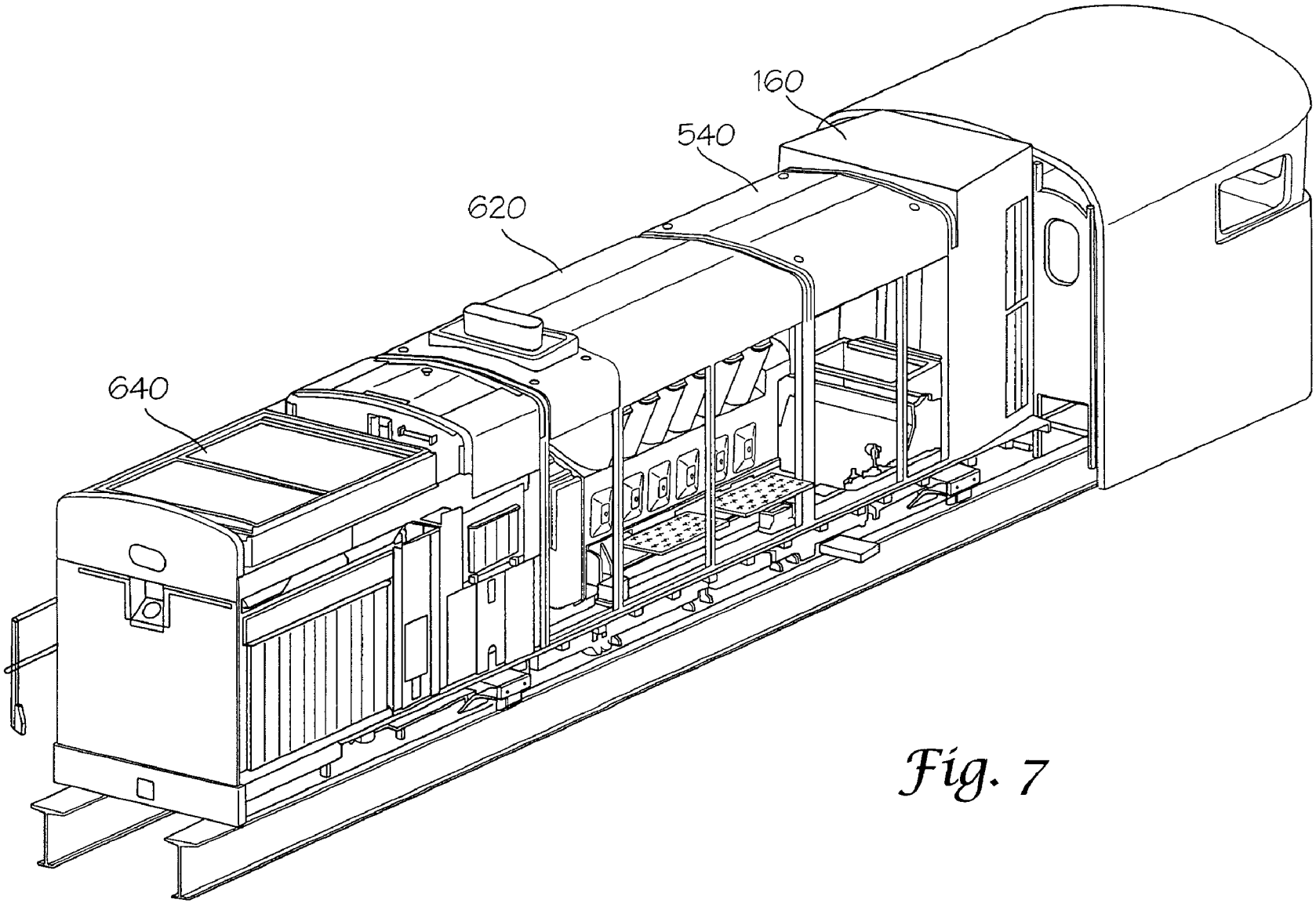
FIG. 7 shows a side perspective view of a propulsion skid module according to an embodiment of the subject invention.

Turning to FIGS. 6 and 7, the various cabs of the propulsion system module 100 and the components contained in each are shown, with the module being orientated with its head end at the left side of FIG. 6 and with its head end at the right side of FIG. 7. FIG. 6 shows a revealed perspective view of the propulsion system module 100. FIG. 6 shows individual cabs with enclosures forming each cab removed to show interior components of the locomotive. The end of the module 100 closest to the operator's cab is the head end 1 and the end of the module 100 opposite is the posterior end, designated as 2. Starting at head end 1, the control device compartment 110 is shown. Further detail of this compartment is provided in FIG. 8. Immediately posterior to the control device compartment 110 is the auxiliary cab 117. The auxiliary cab 117 comprises the power connectors that transfer the electrical power from the alternator 120 to the traction motors. In a typical embodiment, the existing power wires connected at one end thereof to the existing traction motors of the existing locomotive platform are cut at their other ends and new terminals, which would be typically provided with the module 100, are secured onto the cut power wires. The terminals are configured for proper connection with the power connectors located in the auxiliary cab 117. Posterior to the auxiliary cab is the blower cab 160 containing the blower 119. As discussed above, the blower 119 generates airflow into the plenum which may deliver air to other cabs, the control, device compartment 110, rectifier 121, alternator 120, auxiliary generator/exciter 113 and to the traction motors for cooling purposes. Posterior to the blower cab is the alternator cab 540, containing the alternator 120. The alternator 120 is actuated by the engine, which generates electrical power that is carried by wires to the auxiliary cab and then transferred to the traction motors through the power connectors as described above. Posterior to the alternator cab 540 is the engine cab 620 containing the engine 130. Fuel tanks provided in the existing locomotive platform are connected via fuel line(s) to the engine 130. Posterior to the engine cab 130 is a radiator cab 640 containing the air compressor 140. The air compressor 140 produces low volume, high pressure air for the brake system of the locomotive. The air compressor 140 is connected to the existing brake system in the locomotive platform. The radiator cab 640 has its own blower which blows air over a radiator to dissipate heat generated by the engine 130. FIG. 7 shows each of the cabs with partial enclosures and partial unenclosed to reveal contents.

Figure 8:
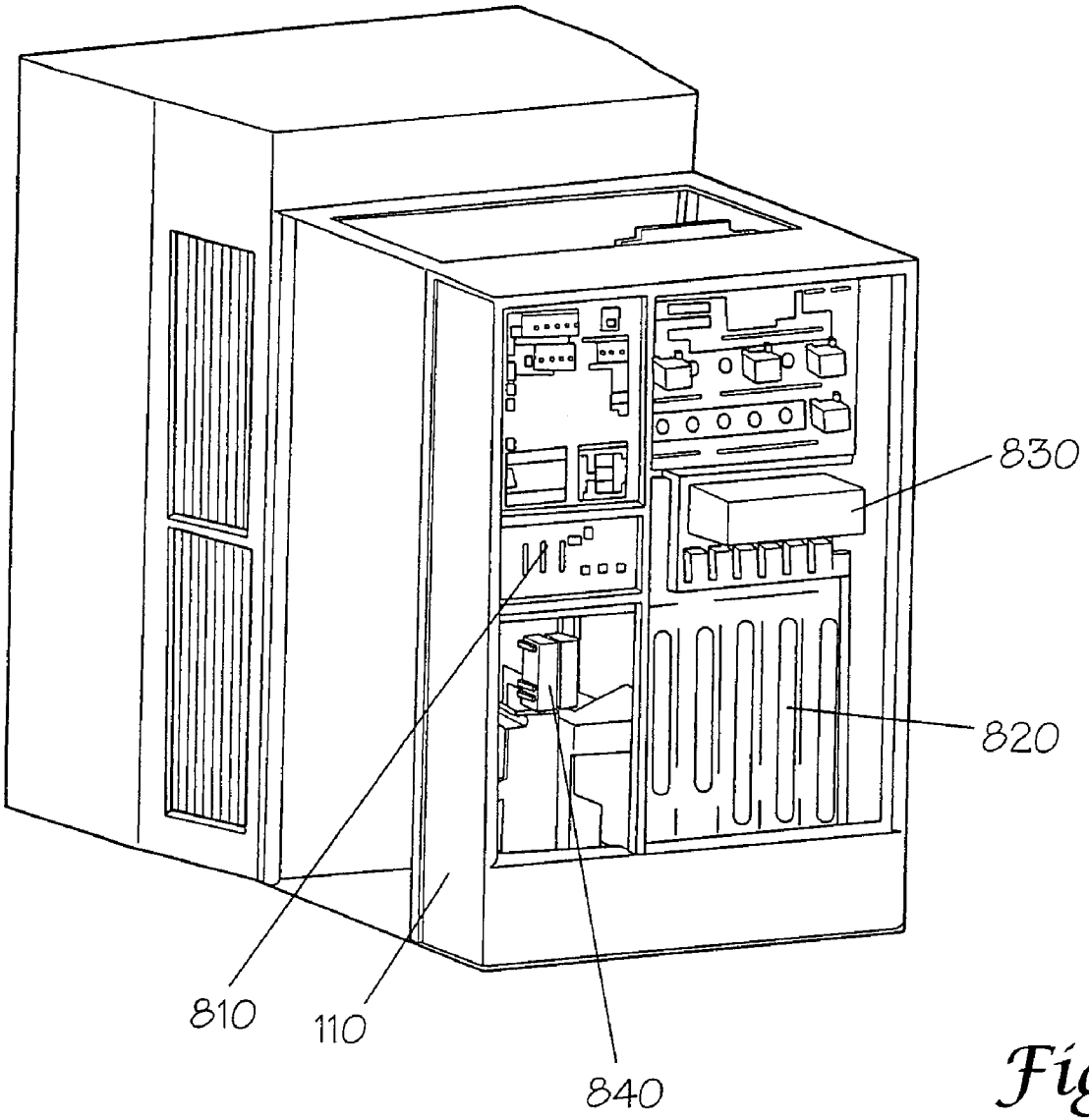
FIG. 8 shows a perspective view of a control device compartment for a propulsion skid module according to an embodiment of the subject invention.

FIG. 8 shows a perspective view of the control device compartment 110 (CDC). The CDC 110 comprises a switch and circuit breaker panel 810 for switching various electrical functions on and off. The CDC 110 also contains terminal boards 820 which provide external wire connections. A computer 830 is provided on the CDC 110, for controlling engine operation and monitoring sensors of engine operation. Also provided is a battery knife switch 840

Figure 9:
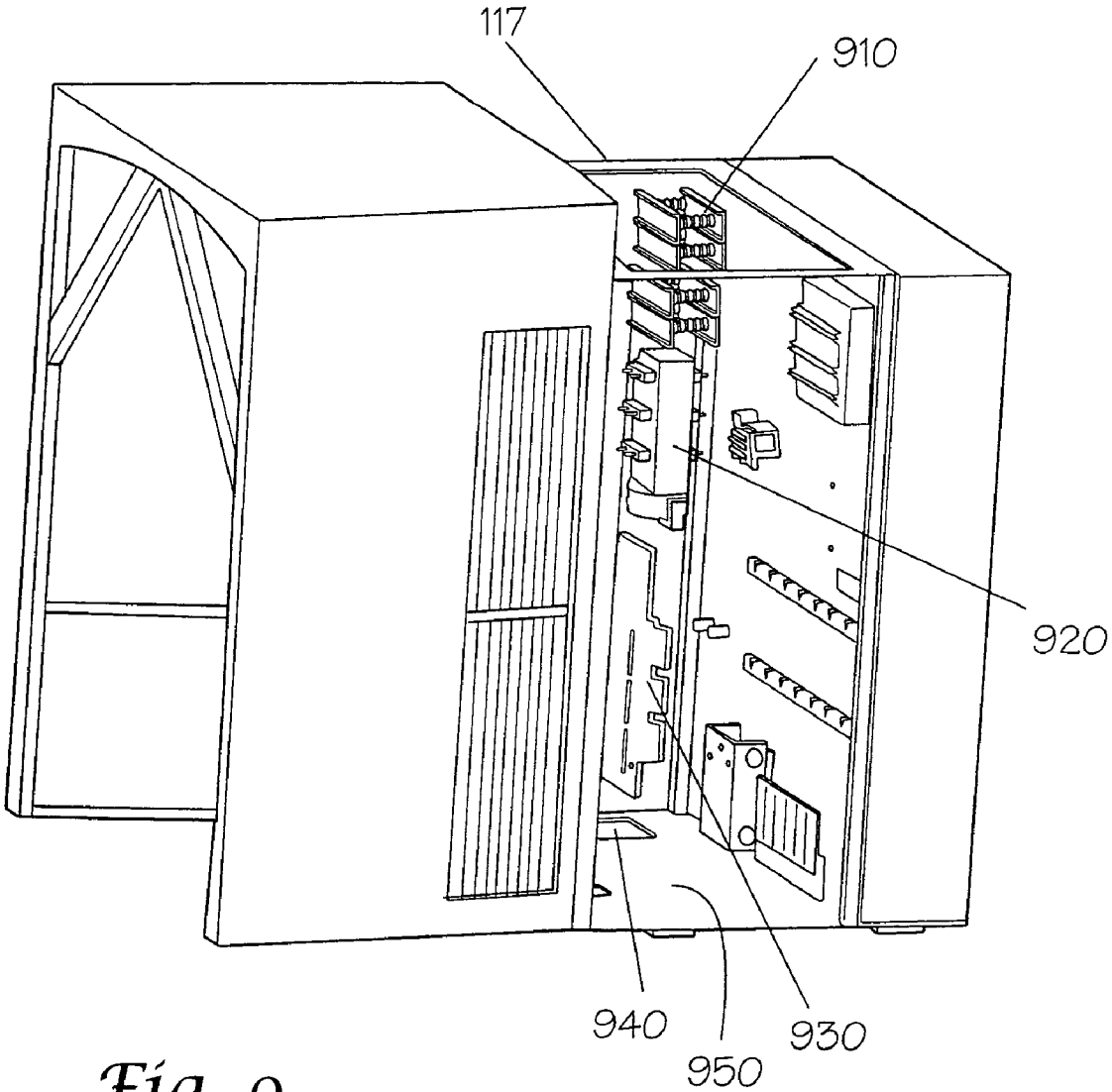
FIG. 9 shows a side perspective view of an auxiliary cab for a propulsion skid module according to an embodiment of the subject invention.

FIG. 9 shows a side perspective view of the auxiliary cab 117. The auxiliary cab 117 comprises a charging resistor 910. The auxiliary cab also comprises field shunting contactors 920. The reverser 930. An access hole 940 is defined on the removable floor 950 of the auxiliary cab 117 for traction motor cable access.

Those skilled in the art will appreciate that the propulsion skid module embodiments according to the subject invention may be adapted for fitting onto a number of locomotive models. Depending on the dimensions and configurations of the locomotive, the propulsion skid module may need to be lengthened or shortened in order to properly fit on a certain locomotive platform. In a specific example, the propulsion system of a Russian 2M62 or, TE 10, TE 114 is removed thereby leaving a platform onto which a propulsion skid module as shown in FIG. 7 (with full cab enclosures, inter alia, and described herein). These locomotives possess a single operator's cabin at one end of the locomotive. In another specific example, a propulsion system of a Russian M62 locomotive is removed. The M62 has two operator cabs, one on each end, and comprises a slightly shorter platform than the 2M62 or TE 114. Thus, the propulsion skid module shown in FIG. 7 will be shortened slightly. Those skilled in the art will appreciate that space in the propulsion skid may be economized in numerous ways. By way of example only, the space removed to accomplish this shortening of the propulsion skid may be removed from the radiator cab. The piping and wiring found in the radiator cab and/or other cabs may be reconfigured so that it can be properly routed in the M62. Furthermore, the cooling system of propulsion skid may be enhanced to meet certain regulatory guidelines, such as UIC-2 emissions requirements.

Figure 10:
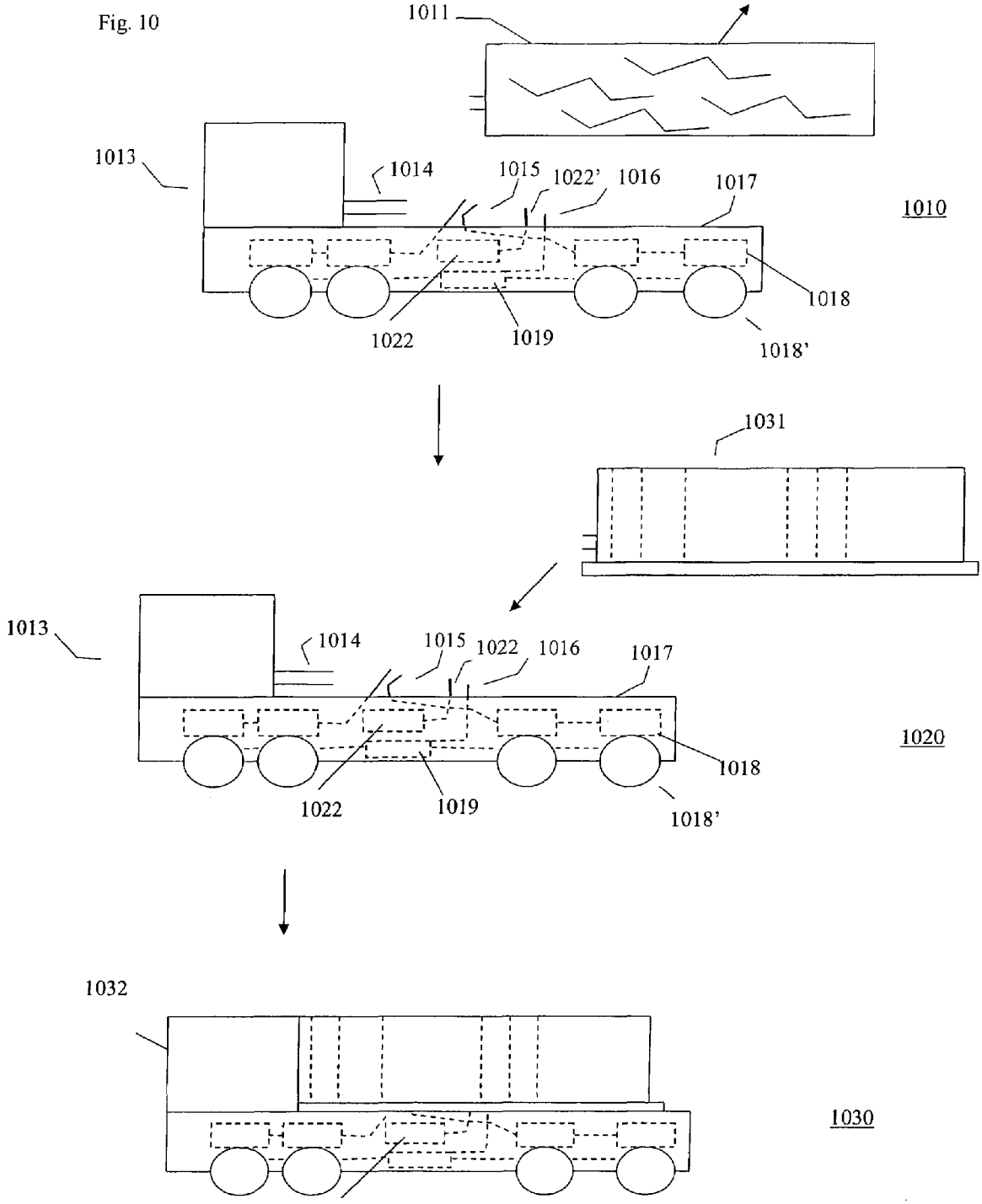
FIG. 10 shows a diagram of a method embodiment of refurbishing an older locomotive.

FIG. 10 shows a basic schematic of a method embodiment for modernizing an older locomotive. In a first step 1010, the old propulsion system 1011 is removed from the platform 1017 thereby leaving a platform 1017 with traction motors 1018, brake system 1019, fuel tank and lines 1022, 1022' and wheels/axles 1018'. The fuel tank may comprise one or more tanks. As part of removing the old propulsion system 1011, the control wiring 1014 from the operator cab 1013 is disconnected from the old system 1011; the brake tubing 1016 is disconnected form the old system 1011; the fuel lines 1022' are removed from the old system 1011, and the power wiring 1015 is removed from the old system 1011. In a second step 1020, a propulsion skid embodiment 1031 is conjoined with the platform 1017. As part of this process, the control wiring 1014, the brake tubing 1016, the fuel line 1022' and the power wiring 1015 are connected up to the new propulsion skid 1031. The power wiring 1015 is connected to power connectors 1033 associated with the propulsion skid embodiment 1031. Typically, the power wiring is connected to the reverser in the auxiliary cab. Upon conjoining the propulsion skid 1031 to the platform 1017, a modernized locomotive is achieved 1032 in the final step of the refurbishing process 1030.

Figure 11:
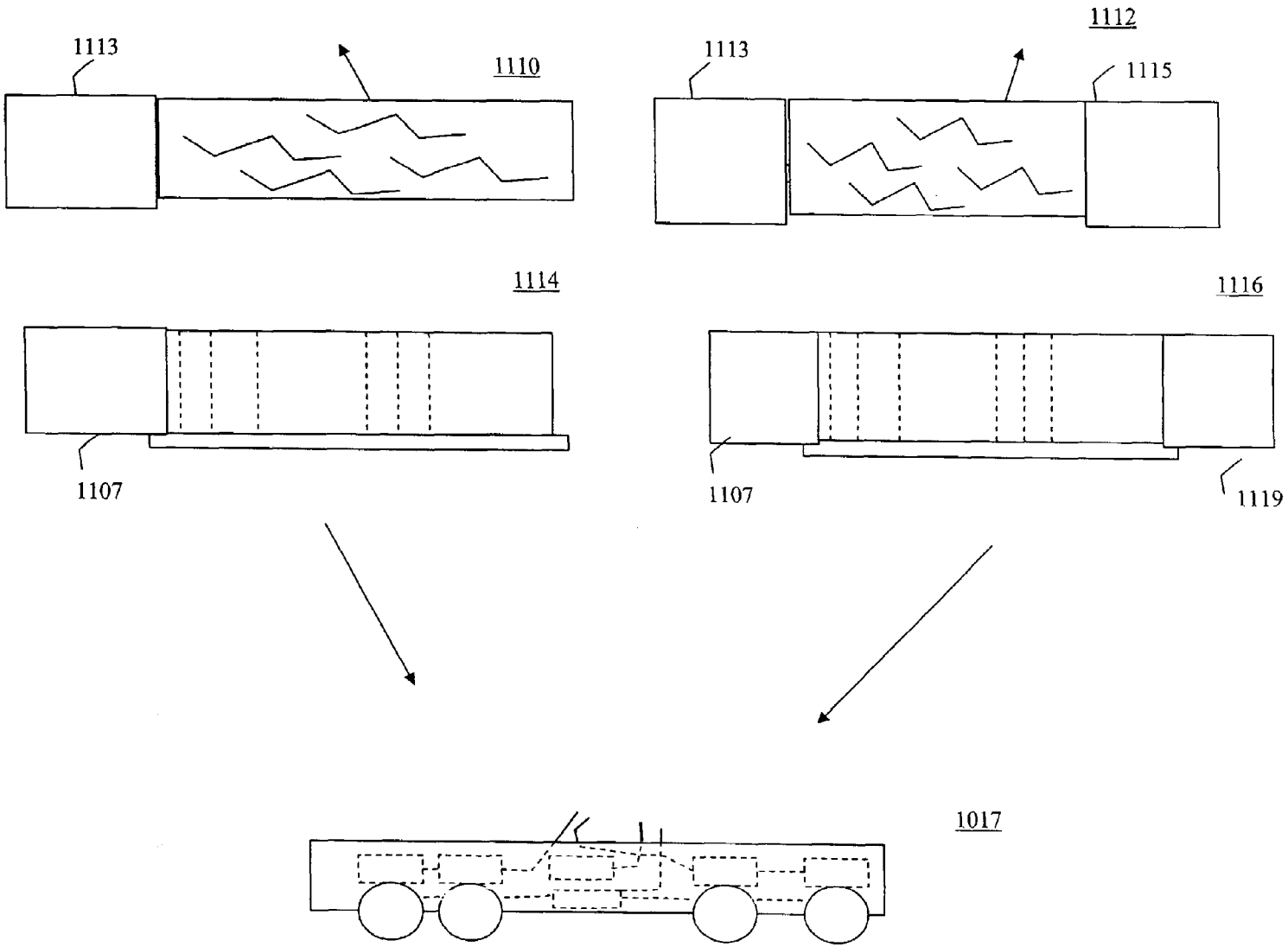
FIG. 11 shows a diagram of a method embodiment of refurbishing an older locomotive.

FIG. 11 shows an alternative method embodiment of refurbishing a locomotive that involves the removal of one or more operator cabs. In a first example, the old propulsion system 1110 comprising one operator cab 1113 at one end is removed from the locomotive platform 1017. In a second example, an old propulsion system 1112 comprising one operator cab at one end 1113 and a second operator cab at the other end 1115 is removed from the locomotive platform 1017. A skid module 1114 comprising one operator cab 1107 associated therewith, or skid module 1116 comprising a first operator cab 1107 and a second operator cab 1119 associated therewith, is secured to the locomotive platform 1017.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A locomotive propulsion system module comprising propulsion system components assembled together as a modular unit installed onto a locomotive platform whose propulsion system and component cabs have been removed but whose traction motors are retained, and, whose operator cab is retained, said module comprising:

a skid base serving as a support for at least one propulsion system component, said skid base comprising at least two elongate support members extending substantially the length of the module at the sides thereof and at least one panel spanning the two support members, and an air plenum defined in said base, wherein said at least one panel comprises a top panel and a bottom panel spanning across said two support members to thereby define said air plenum, and wherein said bottom plate comprises at least one portal defined thereon to pass air from said plenum to said locomotive platform;

an alternator cab containing an alternator secured to said skid base;

an engine cab containing an engine secured to said skid base;

an axilliary cab secured to said skid base containing power connectors for connection to said traction motors;

a blower cab containing a first blower secured to said base for delivery of air under pressure to the air plenum to serve as cooling air directed to the engine, alternator and traction motors; and a radiator cab containing a radiator secured to said skid base and a second blower configured to blow air over said radiator.

2. The locomotive propulsion system module of claim 1 wherein said module further comprises a control device compartment secured to said skid base.

3. A method of replacing a propulsion system of a locomotive comprising removing old propulsion system components, and cabs housing said old propulsion system components, from said locomotive thereby leaving a locomotive platform that comprises an existing operator cab, existing traction motors with electrical power cables, existing fuel tank, and existing brake system;

positioning a propulsion system module according to claim 1 onto said platform;

connecting said fuel tank to said engine;

connecting an air compressor to said locomotive brake system;

connecting said traction motor electric power cables to said power connectors; and connecting wiring from the operator cab to a control device compartment.

4. The method of claim 3, wherein said plenum comprises at least one outlet for delivering forced cooling air to an end use device that requires cooling.

5. The method of claim 4, wherein said end use device comprises at least one of the devices selected from the group consisting of alternator, generator/exciter, rectifier, control device compartment and traction motor.

6. The method of claim 3, wherein said connecting said power cables to said power connectors comprises fixing onto said power cables terminals configured for engagement to said power connectors.

7. The method of claim 3 further comprising delivering air under pressure from the blower to the air plenum to end use devices for cooling.

8. The method of claim 3 further comprising delivering air under pressure from the blower to the air plenum, wherein said air plenum is configured such that air is directed to said traction motors for cooling.

* * * * *